United States Patent [19]

Wouters

[11] 4,357,019

[45] Nov. 2, 1982

[54] FLOATBALL APPARATUS

[76] Inventor: Howard L. Wouters, 3904 118th St. E., Tacoma, Wash. 98446

[21] Appl. No.: 185,164

[22] Filed: Sep. 8, 1980

[51] Int. Cl.[3] ..... A63B 71/02; A63B 61/02

[52] U.S. Cl. ..... 273/411; 273/29 BB

[58] Field of Search ..... 273/411, 29 B, 29 BB, 273/29 BF, 58 B, 58 J, 30, 29 R

[56] References Cited

U.S. PATENT DOCUMENTS

| | | | |
|---|---|---|---|
| 1,356,817 | 10/1920 | Gregory | 273/58 B |
| 3,860,240 | 1/1975 | Koch | 273/411 |
| 3,940,139 | 2/1976 | Barnes | 273/411 |
| 3,968,968 | 7/1976 | Peterson | 273/411 |
| 4,022,471 | 5/1977 | Keller | 273/411 |
| 4,040,214 | 8/1977 | Frye | 273/29 BB X |

*Primary Examiner*—William H. Grieb

*Attorney, Agent, or Firm*—Kenneth S. Kessler

[57] ABSTRACT

An apparatus is disclosed for playing floatball while either inside or outside between two or more players. The apparatus includes a net which attaches between two angularly displaced end posts. The end posts are attached to a weighted base which holds the posts in an upright position. The ball used is spherical in shape and because of its size and weight has the tendency to float across the net whenever it is hit by a player. The diameter of the ball is easily increased or decreased dependent upon the skill of the players.

8 Claims, 3 Drawing Figures

FLOATBALL APPARATUS

BACKGROUND OF THE INVENTION

The increased awareness in physical fitness has influenced many people to become more active in sports. Two examples of sports which have enjoyed increased popularity are volleyball and pickleball. Traditionally, these sports have required heavy equipment and a large area for participation. The area requirement has demanded either an outside setting or a gymnasium type structure. It would be advantageous to allow enthusiasts to participate in a sport involving a ball and net which can be moved indoors without concern for damage. This particular invention is adapted to the above described application, as it utilizes a ball which will, in part, float because of its weight. Further, the base and net apparatus are designed to fit in a typical residence.

A number of U.S. Patents have attempted to address these concerns; that is, they have tried to disclose an apparatus which would be sufficiently practical to allow its users to play indoors. In U.S. Pat. No. 3,968,968 by Peterson, a mini-volleyball court layout is disclosed. More specifically, it discloses an apparatus for playing mini-volleyball by two players who may be disposed in a sitting or kneeling position. The most apparent drawback of this invention is that its users must either sit or kneel in its use.

U.S. Pat. No. 4,022,471 by Keller, discloses a volleyball training and blocking device. It has its main application in the training of volleyball players in the art and defense of spiking. Thus, it is impractical for indoor use.

U.S. Pat. No. 3,940,139 by Barnes, discloses an out-of-bounds wand for a volleyball net and support strap. This invention relates to markers which serve as net boundaries for ball games.

U.S. Pat. No. 3,860,240 by Koch, discloses a volleyball net antenna clamp. This invention discloses the use of vertical antennas which extend above a volleyball net in order to mark the sidelines of a volleyball court.

Beyond the advantage of placement indoors, this game can be varied dramatically in regards to the skill necessary to play. Thus, if the ball is expanded to a fairly large diameter, the ball will float and hang for a small child. If, however, the ball is only expanded to a relatively small diameter, the game becomes fast moving and competitive for an adult. Thus, the scope of the game can be quickly varied to adapt to the skills of the participants.

SUMMARY OF THE INVENTION

The disclosed floatball apparatus can be used by two, three, four, or multiple players. It utilizes a floating balloon type ball, the ball's surface being sufficiently soft to prevent damage to personal property. Thus, the game may be played indoors.

The floatball apparatus also utilizes two angularly displaced support rods which support the playing net. The rods are designed at a pre-determined pitch to deliver greater support for the playing net thereby fostering increased net strength. The net is attached to the rods using a standard attachment mechanism or fittings.

The angularly displaced rods are supported by a weighted base which utilizes insertion holes for the insertion of the support rods.

DETAILED DESCRIPTION OF THE DRAWINGS

Figure 1:
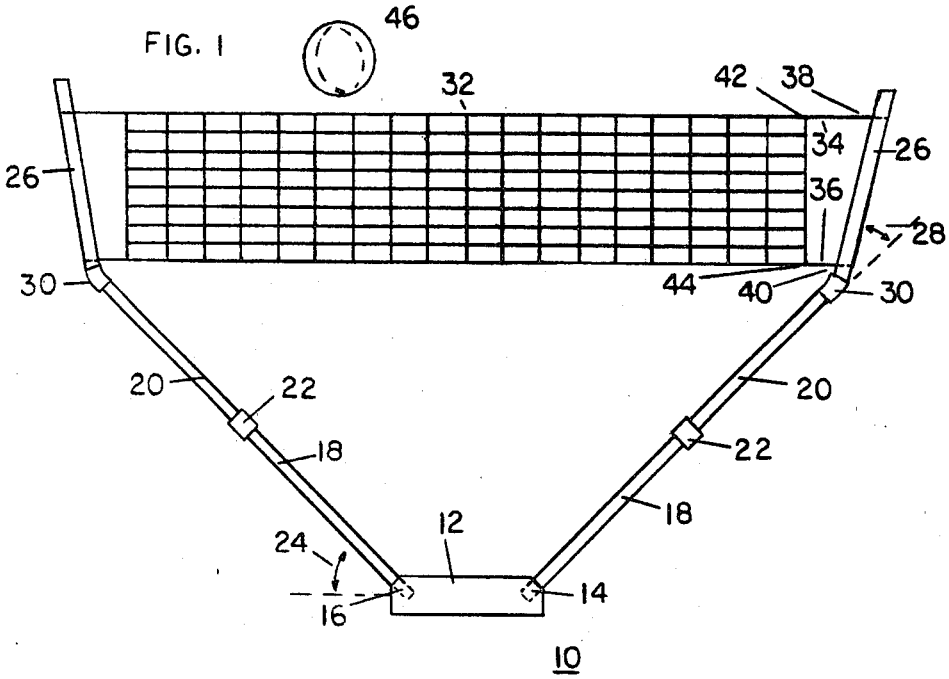
FIG. 1 is a front view of the floatball apparatus.

The floatball apparatus 10 is shown in a front view in FIG. 1. The front view illustrates the present invention in its operative position ready for use.

The floatball apparatus 10 is composed of one weighted base 12 which actually supports the weight of the device. Bored at the predetermined angle within the weighted base 12 are insertion holes 14 and 16. In the preferred embodiment, the insertion holes are bored at a 40 degree angle with relation to the base.

Lower rods 18 attach to the weighted base 12 by being slidably inserted into the insertion holes 14 and 16. Lower rods 18, in the preferred embodiment, attach to extension rods 20 by collars 22.

The lower rods 18 and extension rods 20 extend from the base 12 at a 40 degree angle. By extending the lower rods 18 and extension rods 20 at a 40 degree angle the net may be longer than the base. Thus, the base foundation may be relatively short and the net quite a bit longer. For instance, the base could be set within a coffee table while the net itself extends over the top of the coffee table.

Upper support rods 26 extend from extension rods 20 at a 45 degree angle 28. In the preferred embodiment, the extension rods 20 are secured to the upper support rods 26 by angled collars 30. Since the upper support rods 26 are at a 45 degree angle in relation to the extension rods 20, and the extension and lower rods are at a 40 degree angle 24 with the base 12, the upper support rods 26 are at an approximate 85 degree angle in relation to the base 12.

In the preferred embodiment, the lower extension and upper support rods are all flexible. Thus, when the user connects the net 32 and pulls it taut, the upper support rods 26 can be pulled into an approximate 90 degree relation with the base. This flexibility, when the net is brought taut, also produces strength. Thus, it is very difficult to knock over the floatball apparatus 10 from side to side along the plane of the net 32.

The upper support rods 26 extend upward and act as the mechanism through which the net will attach. Connected to upper support rods 26 are cords 34 and 36 at positions 38 and 40 respectively. Cords 34 and 36 are secured through eyes 42 and 44 which actually support the weight of net 32.

The ball is also capable of being blown up to different diameters. This adds an important aspect of versatility to the game. Thus, if a small child is playing the game the ball is blown to a large diameter which causes the ball to float and hang thereby allowing the child to play the game with interest. If an adult is playing the game the ball is blown up to a size where the balloon just begins to become taut and, thus, the ball travels at a higher rate of speed and the game is more complex.

Although angles 24 and 28 are disclosed to be 40 and 45 degrees respectively, they are only illustrative in nature and, therefore, are not exclusive. Consequently, this invention has the flexibility to the user's requirements for tautness. Thus, the desired tautness will be defined by angles 24 and 28.

Ball 46 is shown above net 32. Ball 46 will be constructed of very light rubberized type material. As a consequence, it will act like a balloon as its ability to float will be enhanced based upon the amount of air inserted.

Figure 2:
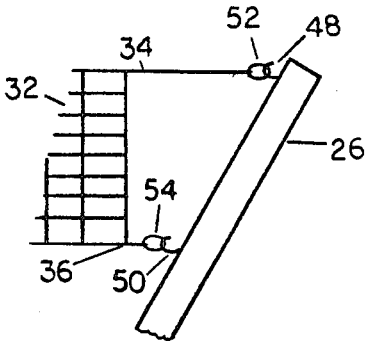
FIG. 2 is a front view of the net and rod attachment.

FIG. 2 is a front view of the net and rod attachment mechanism. Net 32 is shown, which is supported between its boundaries. The tautness of net 32 is thus defined based upon the length of cords 34 and 36. Upper support rod 26 is shown with hooks 48 and 50. These hooks are standard, but they are disclosed to emphasize the flexibility of this invention. In FIG. 1, the net and rod attachment mechanism consists of cords which could be attached to upper support rods 26 by using a standard knot. However, in FIG. 2 hooks 48 and 50 will be attached to loops 52 and 54.

Figure 3:
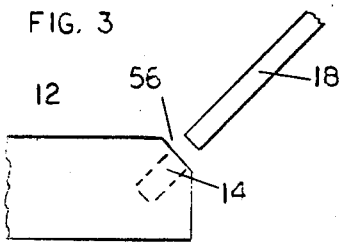
FIG. 3 is a front view of the foundation and support apparatus.

As set forth previously, a weighted base is used as a foundation to support the apparatus. It is further shown in a front view described in FIG. 3. Weighted base 12 is shown with insertion hole sloped at an angle perpendicular to face 56 which is 40 degrees. Because the base has the weight of floatball apparatus 10 it is sufficiently heavy to allow for a larger or longer net in the event that one is required. Lower rod 18 fits into insertion hole 14 at face 56. The depth of insertion hole 14 is such that it sufficiently allows for the weight of lower rod 18, extension rods 20, upper support rods 26, and net tension and thereby cancels out the forces which would otherwise topple the apparatus.

In the preferred embodiment, the apparatus 10 is designed to achieve maximum tautness as set forth in FIG. 1. The apparatus 10 may be easily varied to assume various degrees of tautness by varying either the angles of the upper and lower rods or by changing the tautness of the cords.

Although a particular preferred embodiment of the invention has been disclosed above for illustrative purposes, it is to be understood that variations or modifications thereof which lie within the scope of the appended claims are contemplated.

I claim:

1. A floatball net comprising:

two opposing upper arm supports;

a net affixed between the upper arm supports;

a means for affixing the net to the upper arm supports;

two opposing lower rods;

two angled collars which individually attach the upper arm supports to the lower rods;

a weighted base with insertion holes at opposite ends of the base, each insertion hole capable of receiving a lower rod and affixing each of the lower rods at an identical angular displacement of between 30 and 50 degrees with respect to the horizontal plane of the base.

2. A floatball apparatus comprising two opposing upper arm supports;

a net affixed between the upper arm supports;

a means for affixing the net to the upper arm supports;

two opposing lower rods;

two angled collars which individually attach the upper arm supports to the lower rods;

a weighted base with insertion holes at opposite ends of the base, each insertion hole capable of receiving a lower rod and affixing each of the lower rods at an identical angular displacement of between 30 and 50 degrees with respect to the horizontal plane of the base;

a spherical playing ball.

3. The floatball apparatus of claim 2 wherein a displacement of 40 degrees is formed between the horizontal plane of the base and said lower rods.

4. The floatball apparatus of claim 2 wherein the upper arm supports are identical in configuration and each forms an angular displacement of between 35 and 55 degrees with respect to the lower rods.

5. The floatball apparatus of claim 4 wherein each upper arm support forms an angular displacement of 45 degrees with respect to its corresponding lower rod.

6. The floatball apparatus of claim 5 wherein the lower rods, upper arm supports, and angled collar are all flexible allowing for minor changes in the angles between the base and rods based upon the degree of tautness of the net.

7. The floatball apparatus of claim 6 wherein the weight of the spherical playing ball when filled or partially filled with air is close to the specific gravity of air thereby allowing the ball to float.

8. The floatball apparatus of claim 6 wherein the diameter of the spherical playing ball can be rapidly increased or decreased by the user without the aid of mechanical assistance.

* * * * *